United States Patent [19]

Nelson et al.

[11] 3,962,128

[45] June 8, 1976

[54] COAL DUST FUEL DISTRIBUTION SYSTEM AND METHOD OF MANUFACTURING ACTIVATED CARBON

[75] Inventors: James D. Nelson; Gert R. Winge, both of Covington, Va.

[73] Assignee: Westvaco Corporation, New York, N.Y.

[22] Filed: July 5, 1974

[21] Appl. No.: 486,101

[52] U.S. Cl. ..... 252/421; 110/104 R; 202/104; 252/445; 302/57; 432/139

[51] Int. Cl.[2] ..... B01J 21/18; B01J 31/10; F23K 3/02; B65G 53/40

[58] Field of Search ..... 252/421, 445; 423/449; 201/36; 302/52, 57, 58, 66; 110/104 R; 432/138, 139

[56] References Cited

UNITED STATES PATENTS

| | | | |
|---|---|---|---|
| 327,210 | 9/1885 | Westlake | 302/57 |
| 1,042,576 | 10/1912 | Lindhard | 110/104 R |
| 3,033,134 | 5/1962 | Hennecke | 110/104 R |
| 3,204,942 | 9/1965 | Matthys et al. | 110/104 R |
| 3,843,559 | 10/1974 | Repick et al. | 252/421 |
| 3,876,505 | 4/1975 | Stoneburner | 201/36 |

FOREIGN PATENTS OR APPLICATIONS

| | | | |
|---|---|---|---|
| 784,139 | 7/1935 | France | 252/445 |
| 546,531 | 7/1942 | United Kingdom | 252/421 |

*Primary Examiner*—Winston A. Douglas
*Assistant Examiner*—P. E. Konopka
*Attorney, Agent, or Firm*—W. Allen Marcontell; Richard L. Schmalz

[57] ABSTRACT

Coal dust comprising coal particles of 40 mesh or less may be utilized as a fuel for stable combustion by aspirating the dust in fluidized suspension for delivery to a turbulent reservoir and aspirating the suspension from the reservoir for delivery to a combustion zone.

4 Claims, 2 Drawing Figures

COAL DUST FUEL DISTRIBUTION SYSTEM AND METHOD OF MANUFACTURING ACTIVATED CARBON

BACKGROUND OF THE INVENTION

1. Field Of The Invention

The present invention generally relates to the fluidized conveyance of particulate solids. More particularly, the present invention relates to powdered coal distribution systems for fuel support of heat generating furnaces.

2. Description Of The Prior Art

In the utilization of coal as a fuel and raw material for activated carbon manufacture, moderate to large percentages of chunk coal are reduced to "dust" in handling and transit. For the purposes herein, dust may be defined as particles of approximately 40 mesh or less.

As a fuel, coal dust has excellent properties of high heat value and heat release rate. In practice, however, coal dust has proven to be a very difficult fuel to manage from the perspective of uniform combustion rate due to furnace feed and distribution complications.

In the case of activated carbon manufacture from coal where the volumetric rate of material processed is particularly large, proportionately large quantities of coal dust are generated. As to the manufacture of activated carbon product, coal dust is largely useless since the particles are too small to tolerate the selective oxidization process through a multihearth combustion furnace. Instead of carbonizing, hydrocarbons in the small particles are consumed by combustion leaving only fly ash. Such combustion within the product flow stream cannot be relied upon as a heat source to the process due to the erratic and uncontrolled nature thereof.

Accordingly, due to the large quantities of productively useless material having a high heat value, it would be particularly useful for activated carbon manufacturing facilities to utilize such material independently as fuel to fire the multihearth furnaces in which the parent material is provided stable, controlled heat for activation.

Unfortunately, however, multihearth carbon activation furnaces present a severe challenge to distributing coal dust due to the relatively complicated arrangement of requiring one or more fuel injection points on each of several, vertically spaced hearth levels.

The greatest difficulty in distributing coal dust is the tendency of the material to pack, within a fluidized flow stream, in "slugs" within the flow stream. As these slugs enter the combustion zone, combustion stability and uniformity of heat release suffer.

The following United States Patents represent prior art efforts at fluidizing a coal dust flow stream for furnace distribution: U.S. Pats. No. 2,053,340; 2,841,101; 2,960,324; 3,204,942; 3,267,891 and 3,306,238.

Such prior efforts have been less than satisfactory due to equipment complications or voluminous quantities of carrier medium (air) required for suspended flow.

It is, therefore, the object of the present invention to teach a method and apparatus for uniformly distributing coal dust in a fluidized flow stream as a fuel supply for heat generating furnaces.

It is another object of the present invention to teach a coal dust fuel distribution system wherein mechanical constituents having relatively few moving elements are isolated from the abrasive fuel mixture flow stream.

Another object of the present invention is to teach a low pressure, low carrier medium volume system for fluidized transport of coal dust.

Still another object of the present invention is to teach a process flow system for the manufacture of activated carbon wherein dust from raw material coal is utilized to heat the carbonization furnaces.

SUMMARY OF THE INVENTION

Coal dust, from either a pulverizing mill or reduced from transport and handling of chunks, is aspirated from a storage bin with low pressure air and carried in fluidized transport to a low pressure mixing chamber where it is held in uniformly distributed, turbulent suspension until drawn off by distribution line aspirators for furnace injection.

The entire system is closed and no moving machine elements contact the air/dust mixture.

A total air supply in the order of 15–20 SCF air/-pound of coal dust should be adequate for most applications.

Only small diameter, relatively light gauge pipe is required for mixture conduits.

BRIEF DESCRIPTION OF THE DRAWINGS

Relative to the drawing wherein like reference characters denominate the same or similar elements in the two figures.

DESCRIPTION OF THE PREFERRED EMBODIMENT

In the process sequence of manufacturing activated carbon from coal, the coal is initially graded as to particle size with particles passing a 40 mesh screen being segregated from the larger granules.

The 40 mesh and smaller particles, hereinafter characterized as coal dust, constitutes a representative fuel source for the present invention.

The larger sized coal granules constitute the main product flow stream to the carbon activation process and is subsequently subjected to a precarbonization treatment as is known to the prior art. Such precarbonization treatment may further abrade and erode the granule flow stream thereby reducing additional quantities of coal to dust particle size. Accordingly, if desired, additional screening of the product flow stream following precarbonization will produce additional quantities of coal dust for fuel.

Figure 1:
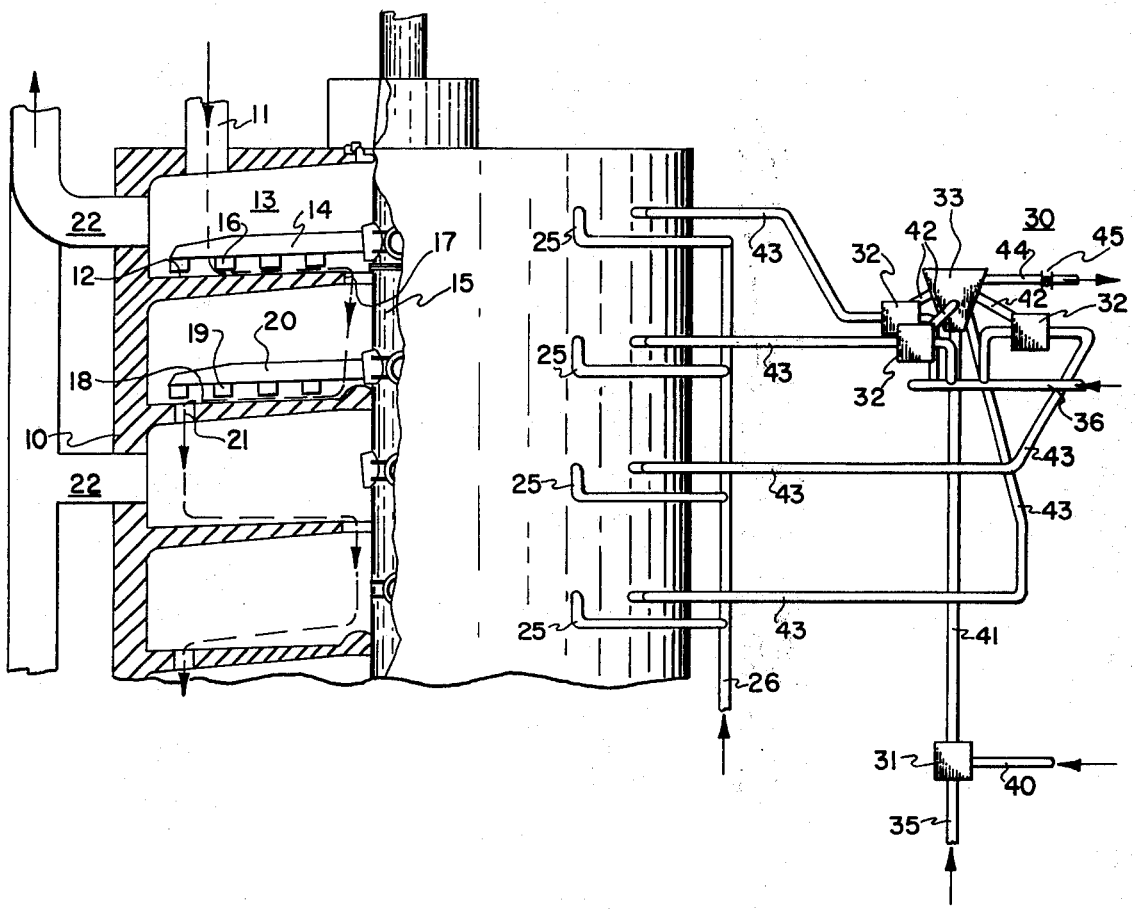
FIG. 1 is a process flow schematic for activated carbon showing a multihearth selective oxidation furnace equipped with the present invention for fuel distribution and delivery.

Relative to FIG. 1, the product flow stream of precarbonized granules is continuously introduced to a multihearth selective oxidation furnace 10 through inlet 11. The granules fall from the inlet 11 to the floor 12 of the first hearth 13.

Rotatively sweeping arms 14 secured to a central rotary column 15 are provided with vanes 16 to spread the coal influx uniformly over the hearth floor 12 and agitate the standing layer.

Vanes 16 are also pitched whereby the coal bed layer in hearth 13 is gradually swept inwardly toward the central aperture 17 in floor 12 to be dropped to the next lower hearth floor 18.

Vanes 19, on sweep arm 20 are pitched to sweep the coal bed radially outward to peripherial apertures 21 to be passed through the floor 18 to the next lower hearth level.

Flowing across and counter-current to the coal bed are combustion flue gases which heat and burn off the hydrocarbon volatiles in the coal.

Flue gas exits 22 may be provided at alternate hearth levels or at other obvious draft positions.

Seen at the right-hand, exterior portion of the FIG. 1 furnace 10 is the fuel distribution conduit system of the present invention. As shown, each hearth level is provided with fuel supply. A more conventional arrangement, however, is to provide fuel supply to only alternate hearth levels.

Also shown with the fuel supply system is an external air supply system including air supply manifold 25 and a distribution conduit 26 respective to each fuel injection point.

In addition to associate piping, the fuel supply system 30 comprises a primary aspirator 31, a secondary or booster aspirator 32 for each distribution line and a mixing chamber 33.

Fuel supply system 30 piping comprises an air supply line 35 to aspirator 31 and a manifold supply 36 to booster aspirator 32.

Coal dust supply line 40 may comprise a bin hopper, conduit or a screw conveyor.

Mixed fuel supply conduit 41 connects the primary aspirator 31 to mixing chamber 33 whereas porting conduits 42 connect the mixing chamber 33 to each of the secondary aspirators 32.

Distribution conduits 43 carry the fluidized mixture of dust and air from the secondary aspirators 32 to the combustion zone of respective hearths.

Conduit 44 is directed back to the dust bin or other appropriate reservoir, not shown, and, via valve 45, serves as a bin pressure control circuit for excess fuel supply recirculation.

Figure 2:
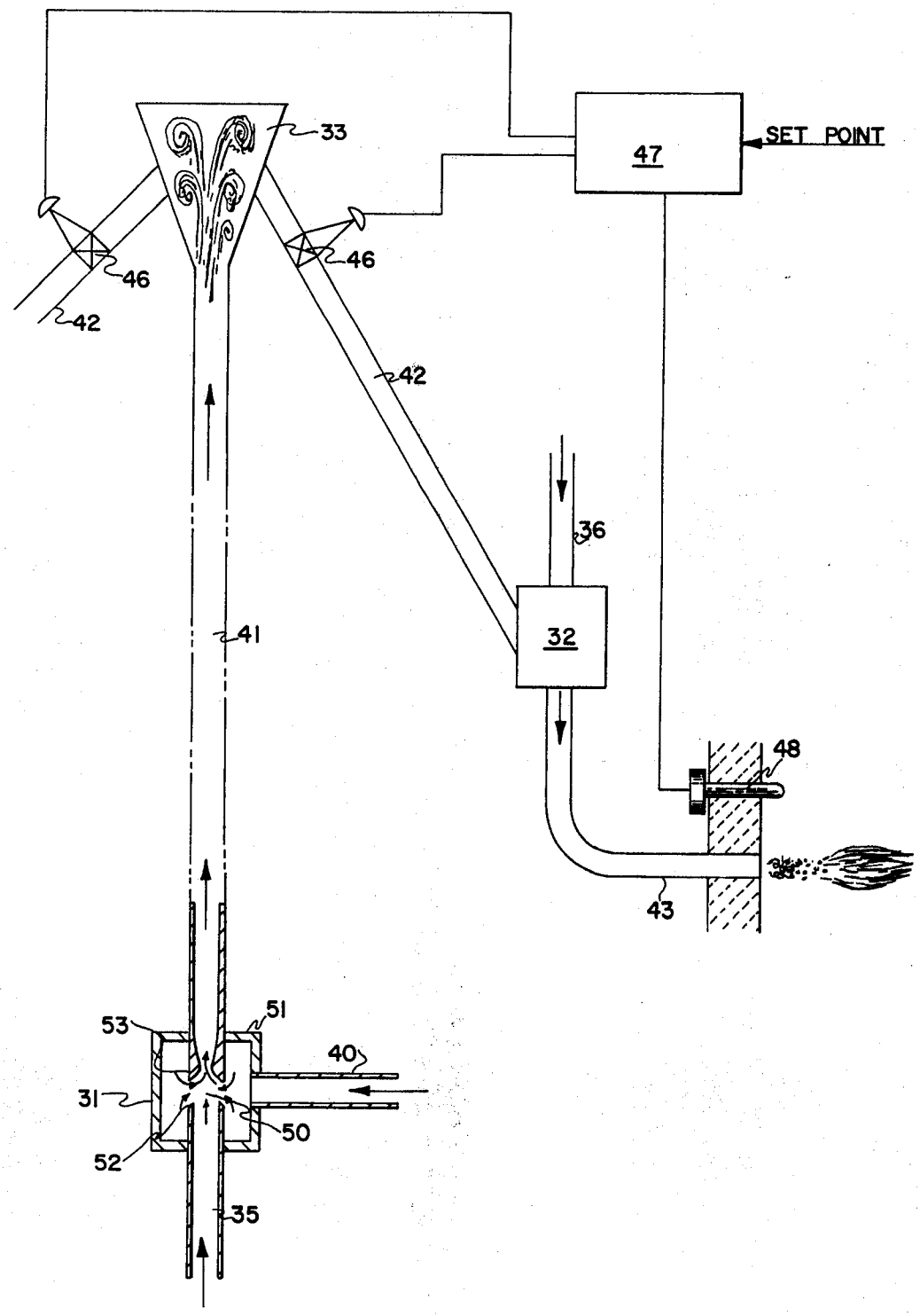
FIG. 2 is an enlarged flow schematic of the present invention showing the essential nature of the several components.

Relative to the operation of fuel supply system 30, reference to FIG. 2 is made wherein internal details of primary aspirator 31 are shown.

Air supply line 35, which, for a 1500 lb/hr. coal supply, may be fabricated from a convenient size pipe to delivery approximately 77 SCFM of air at a minimum of 6 psig to the evacuation zone 50 of aspirator 31. The mild vacuum created by air expansion within zone 50 draws powdered coal into the flow stream from a powder receiving chamber 51 surrounding the zone 50 through intake ports 52.

Successive of expansion, the air flow stream from supply line 35 mixed with dust from receiver 51 reenters conduit flow at the throat of nozzle 53 to be further expanded into the 3 inch mixed fuel supply conduit 41.

At the point of entry into mixing chamber 33, the pressure within mixed fuel supply conduit 41 may be in the order of 2 psig.

Mixing chamber 33 is a simply fabricated conical or pyramidical apparatus of approximately 4 feet axial length for the present flow rate example and has a minimum side angle to the horizontal plane of 45°. Porting conduits 42 open into the sloping side walls of mixing chamber 33 along the approximate midspan region thereof at a downwardly sloped angle. For the exemplary flow rate, 5 porting conduits 42 of 2 inch size depending from the aforedescribed mixing chamber 33, provide satisfatory performance.

Booster aspirators 32 are identical in design and operation to that of primary aspirator 31 and are preferably located at a lower level than the entry position of porting conduits 42 into mixing chamber 33. Regulator valves in conduits 42 responsive to electrical or pneumatic signals from controller 47 are auxiliary refinements to the fuel supply system to meter the fuel supply to each hearth. Temperature sensor 48 serves to signal the temperature of the hearth, such signals being received by controller 47 for comparison to a set point signal. Control signals for valves 46 are proportional to the difference between set point signals and those from sensors 48.

The total aspiration capacity of booster 32 should equal or slightly exceed that of primary aspirator 31 so as to prevent a pressure accumulation within mixing chamber 33. Accordingly, the same air supply of 77 SCFM at a minimum of psig to each booster aspirator 32 will provide the appropriate balance to a system according to the present example.

Collectively, therefore, the total system demand for air is 27,000 SCF/hr. to move 1500 lb/hr. of coal dust: the ratio being 18.5 SCF air/pound of coal dust.

As a design limitation, fuel distribution conduits 42 should be sized and routed so as to allow no more than 1 psig pressure drop between the aspirator 36 and the hearth injection point. The same limitation is applicable to the mixed fuel supply conduit 41.

We claim:

1. A method of manufacturing coal based activated carbon comprising the steps of:

A. segregating coal dust particles of 40 mesh and less from a bulk coal supply;

B. transporting coal particles larger than 40 mesh from said bulk supply through a multihearth activation furnace;

C. aspirating said dust particles into a first fluidized mixture stream with a first air flow stream;

D. delivering said first fluidized mixture stream to a mixing chamber;

E. holding said dust particles in turbulent fluidized suspension within said mixing chamber;

F. aspirating a second fluidized mixture stream from said mixing chamber to a combustion hearth of said multihearth activation furnace with a second air flow stream;

G. conducting a third fluidized mixture stream from said mixing chamber to a particle reservoir; and H. controlling the relative flow rates of said first, second, and third fluidized mixture streams whereby the combined flow rates of said second and third mixture streams equal or exceed said first mixture stream.

2. A method as described by claim 1 wherein said coal particles of larger than 40 mesh are subjected to a precarbonization process step preceeding said multihearth activation furnace, said particle segregation step occurring before and after said precarbonization step.

3. In combination with a heat generating furnace, a fuel distribution system for delivering particulate coal dust to a combustion hearth of said furnace, said distribution system comprising:

A. a bulk reservoir for said coal dust;

B. a first aspirator having a chamber proximate of a low pressure induction zone of said first aspirator for receiving said coal dust from said reservoir;

C. a first pressurized air supply source connected to said first aspirator for evacuating said coal dust from said chamber into a first fluidized flow stream;

D. a mixing chamber having a first conduit connected therewith for receiving said first fluidized flow stream and holding a fluidized mixture of air and coal dust in turbulent suspension;

E. a second aspirator having a receiving chamber and low pressure induction zone flow connected to said mixing chamber through a second conduit;

F. a second pressurized air supply source connected to said second aspirator for evacuating said fluidized mixture from said second aspirator receiving chamber into a second fluidized flow stream for delivery to said furnace combustion hearth; and, G. a third conduit having flow control means therein connected to said mixing chamber for venting a select portion of fluidized mixture within said mixing chamber therefrom.

4. A method of firing a heat generating furnace combustion hearth with coal dust having a particle size of 40 mesh or less, said method comprising the steps of:

A. providing a bulk reservoir for said coal dust;

B. aspirating said dust from said reservoir into a first fluidized mixture stream with a first air flow stream;

C. delivering said first fluidized mixture stream to a mixing chamber;

D. holding said dust in turbulent fluidized suspension within said mixing chamber;

E. aspirating a second fluidized mixture stream from said mixing chamber to a furnace combustion hearth with a second air flow stream;

F. conducting a third fluidized mixture stream from said mixing chamber to a recirculation system; and G. controlling the relative flow rates of said first, second and third fluidized mixture streams whereby the combined flow rates of said second and third mixture streams equal or exceed said first mixture stream.

* * * * *